US011679957B2

(12) United States Patent
Trottmann et al.

(10) Patent No.: US 11,679,957 B2
(45) Date of Patent: Jun. 20, 2023

(54) METHOD FOR OPERATING AN ELEVATOR FOR AN INSPECTION

(71) Applicant: Inventio AG, Hergiswil (CH)

(72) Inventors: Gilles Trottmann, Immensee (CH); Valerio Villa, Colverde (IT); Teresa Zotti, Ebikon (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/757,148

(22) PCT Filed: Nov. 27, 2020

(86) PCT No.: PCT/EP2020/083673
§ 371 (c)(1),
(2) Date: Jun. 10, 2022

(87) PCT Pub. No.: WO2021/121905
PCT Pub. Date: Jun. 24, 2021

(65) Prior Publication Data

US 2022/0356043 A1 Nov. 10, 2022

(30) Foreign Application Priority Data

Dec. 17, 2019 (EP) ..... 19217052.0

(51) Int. Cl.
*B66B 5/00* (2006.01)

(52) U.S. Cl.
CPC ..... *B66B 5/0087* (2013.01); *B66B 5/005* (2013.01)

(58) Field of Classification Search
CPC ..... B66B 5/0087; B66B 5/005
See application file for complete search history.

(56) References Cited

U.S. PATENT DOCUMENTS 6,604,611 B2 * 8/2003 Liu ..... B66B 5/0025 187/316
8,602,171 B2 * 12/2013 Vogl ..... B66B 5/005 187/314
9,272,878 B2 * 3/2016 Kocher ..... B66B 5/005
(Continued)

FOREIGN PATENT DOCUMENTS

WO 2017212105 A1 12/2017
WO 2017212106 A1 12/2017
(Continued)

*Primary Examiner* — Michael A Riegelman
(74) *Attorney, Agent, or Firm* — William J. Clemens; Shumaker, Loop & Kendrick, LLP

(57) ABSTRACT

A method for operating an elevator having a car, a drive engine, shaft doors, signal receptors, an engine controller and a door controller. Each of the shaft doors is reciprocally opened and closed by an associated active door drive and has one of the signal receptors thereat. The method includes: receiving a requesting signal at one of the signal receptors; responding to the requesting signal by instructing the engine controller to control the drive engine to displace the car to a first position with the car roof adjacent to the shaft door at the floor from which the requesting signal originated when that floor is not the lowermost floor, and when the floor is the lowermost floor to a second position above the lowermost floor; instructing the door controller to control the door drive to actively open the door; and switching the engine controller to an inspection mode.

15 Claims, 1 Drawing Sheet

(56) References Cited

U.S. PATENT DOCUMENTS

| | | | | |
|---|---|---|---|---|
| 10,414,628 | B2 * | 9/2019 | Terry | B66B 1/468 |
| 10,526,172 | B2 * | 1/2020 | Meguro | B66B 13/16 |
| 11,072,515 | B2 * | 7/2021 | Witczak | B66B 1/3461 |
| 11,505,428 | B2 * | 11/2022 | Walker | B66B 1/3415 |
| 2006/0108181 | A1 * | 5/2006 | Bacellar | B66B 1/34 187/247 |
| 2008/0047783 | A1 * | 2/2008 | Vogl | B66B 5/005 187/314 |
| 2009/0314583 | A1 * | 12/2009 | Pustelniak | B66B 5/0087 187/247 |
| 2012/0018256 | A1 * | 1/2012 | Mangini | B66B 5/005 250/353 |
| 2012/0222917 | A1 * | 9/2012 | Villa | B66B 1/3492 187/293 |
| 2018/0319625 | A1 * | 11/2018 | Mustonen | B66B 1/3438 |
| 2022/0017334 | A1 * | 1/2022 | Stocker | B66B 13/26 |
| 2022/0356043 | A1 * | 11/2022 | Trottmann | B66B 5/005 |

FOREIGN PATENT DOCUMENTS

| | | | |
|---|---|---|---|
| WO | 2019029862 | A1 | 2/2019 |
| WO | WO-2022101212 | A1 * | 5/2022 |

* cited by examiner

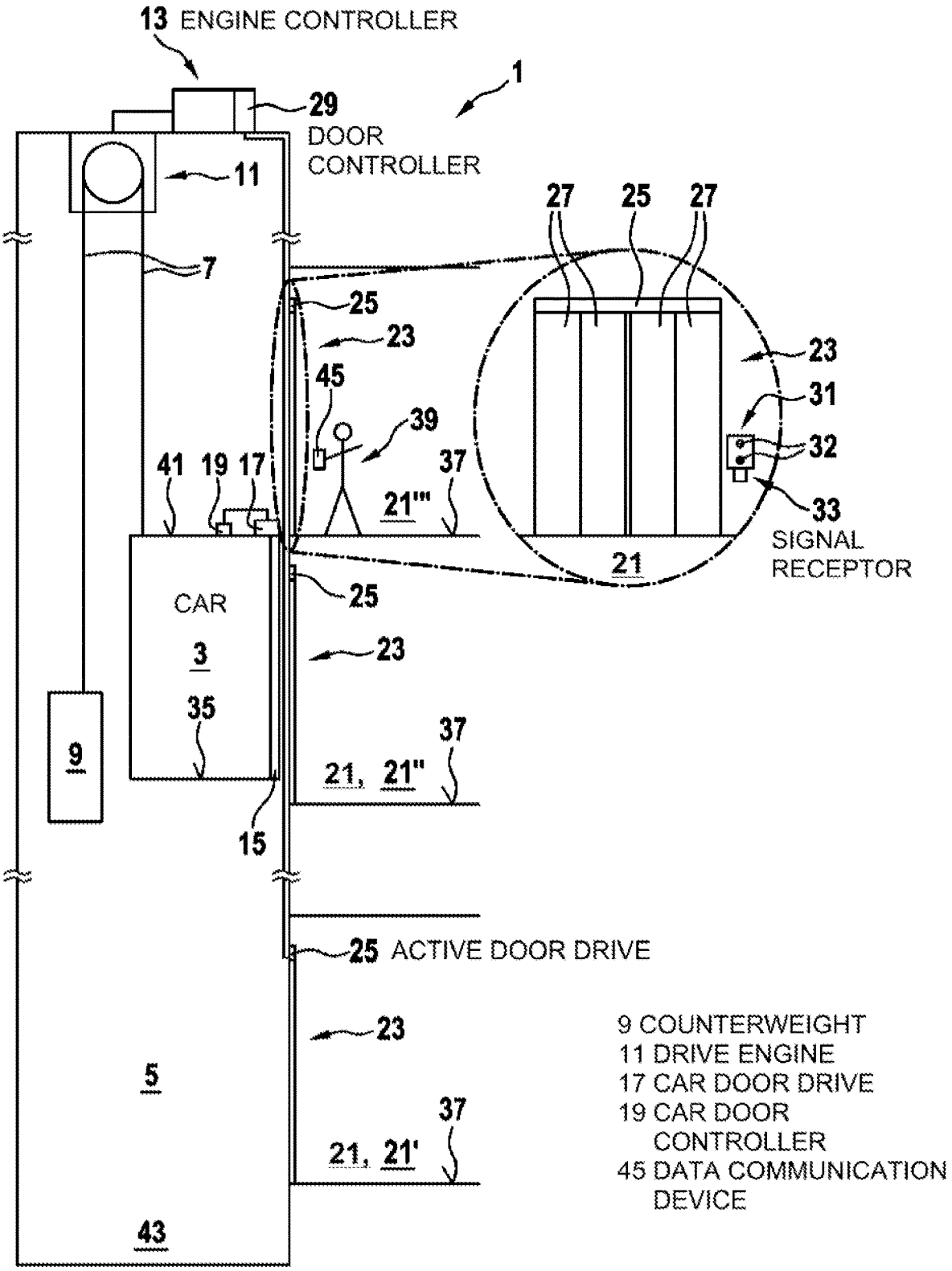
13 ENGINE CONTROLLER
1
29
DOOR
CONTROLLER
11
7
27
25
27
25
23
45
39
23
31
32
41
19
17
37
21'''
33
SIGNAL
RECEPTOR
21
CAR
3
25
23
35
9
37
21, 21''
15
25 ACTIVE DOOR DRIVE
23
5
37
21, 21'
43
9 COUNTERWEIGHT
11 DRIVE ENGINE
17 CAR DOOR DRIVE
19 CAR DOOR
CONTROLLER
45 DATA COMMUNICATION
DEVICE

METHOD FOR OPERATING AN ELEVATOR FOR AN INSPECTION

FIELD

The present invention relates to a method for operating an elevator for an inspection. Furthermore, the present invention relates to an elevator configured for executing such method, to a computer program product and to a computer readable medium.

BACKGROUND

An elevator comprises at least one car which may be displaced along an elevator shaft between multiple floors in a building using a drive engine. Typically, the car comprises at least one car door which may be opened and closed for providing and blocking access to the car, respectively. For such purpose, one or more car door blades of the car door are generally coupled to an active car door drive comprising for example a motor for displacing the car door blades. Furthermore, at each of the floors, at least one shaft door is provided which may be opened and closed for selectively providing or blocking access to the elevator shaft. The shaft doors are sometimes referred to as landing doors. Conventionally, the shaft doors do not have an active door drive. Instead, upon the car being stopped at one of the floors, the car door may be mechanically coupled to the shaft door at this floor such that the shaft door may be opened and closed together with the car door. In other words, the car door drive indirectly also opens and closes the shaft door in front of which the elevator car is currently stopped. Furthermore, as long as the car door is not coupled to a shaft door, the shaft door is generally locked in its closed state.

During an inspection of the elevator, a technician requires access to the elevator shaft in order to e.g. be able to inspect an integrity of components of the elevator comprised within the elevator shaft. For such purpose, in conventional elevators, the technician had to call the car to come near to one of the floors and set the elevator into an inspection mode in which calls from landing operation panels or a car operation panel were ignored. Then, the technician had to unlock the shaft door. For such unlocking, the technician had to use for example specific tools such as a triangular key to cooperate with a specific mechanism within the shaft door for unlocking the shaft door. Then, the technician had to manually open the shaft door and e.g. get onto a roof of the waiting car. At such roof, a control unit was typically provided. Using such control unit, the technician was able to control the drive engine while in inspection mode for displacing the car to a desired location within the elevator shaft. Substantial security measures had to be taken in order to guarantee that the technician was not hurt during such displacing action. For example, it had to be guaranteed that during the inspection, the car was not driven to a location where the technician on top of its roof or another technician for example in a pit of the elevator shaft was endangered. Finally, upon having completed the inspection, the technician had to exit the elevator shaft and manually relock the associated shaft door.

Approaches for opening a locking of a landing door of an elevator are suggested e.g. in WO 2017/212105 A1 and WO 2017/212106 A1.

SUMMARY

There may be a need for an alternative method for operating an elevator for an inspection. Particularly, there may be a need for a method of operating an elevator for an inspection in which a technician may have access to the elevator shaft with minimum efforts and/or wherein a safety level for the technician may be increased. Furthermore, there may be a need for an elevator, a computer program product and/or a computer readable medium configured for implementing such method.

Such needs may be met with the subject-matter of one of the advantageous embodiments that are defined in the following specification.

According to a first aspect of the present invention, a method for operating an elevator for an inspection is proposed. Therein the elevator comprises a car being displaceable along an elevator shaft, a drive engine for displacing the car, a plurality of shaft doors, a plurality of signal receptors, an engine controller for controlling an operation of the drive engine and a door controller for controlling an operation of the active door drives of the shaft doors. At least one of the shaft doors is arranged at each of multiple floors including a lowermost floor and at least one upper floor. Each of the shaft doors has an associated active door drive for reciprocally opening and closing the shaft door. At least one of the signal receptors is arranged at each of the multiple floors. The method comprises at least the following steps:

receiving a requesting signal at one of the signal receptors located at one of the floors, in reaction to the receiving of the requesting signal:

- if the one of the floors is not the lowermost floor, instructing the engine controller to control the drive engine to displace the car to a position (called herein "first position") such that a roof of the car is adjacent to the shaft door at the one of the floors,
- if the one of the floors is the lowermost floor, instructing the engine controller to control the drive engine to displace the car to a position (called herein "second position") above the lowermost floor,
- then, instructing the door controller to control the door drive of the shaft door at the one of the floors to actively open, and switching the engine controller to an inspection mode.

The method steps may preferably be executed in the indicated order. For security reasons, at least in case the car is to be displaced, the opening of the shaft door must not be instructed before the car arrived at its destination location and is stopped. However, other ones of the method steps may be executed in a different order. For example, the inspection mode may be initiated directly upon receiving the requesting signal, i.e. before displacing the car and/or opening the shaft door.

According to a second aspect of the invention, an elevator is proposed, the elevator comprising the features indicated above for the first aspect of the invention and being configured to one of executing and controlling the method according to an embodiment of the first aspect of the invention.

According to a third aspect of the invention, a computer program product is proposed. The computer program product comprises computer readable instructions which, when performed by a processor in an elevator according to an embodiment of the second aspect of the invention, instructs the elevator to one of executing and controlling the method according to an embodiment of the first aspect of the invention. Alternatively, the computer program product comprises computer readable instructions which, when performed by a processor in a mobile data communication device, instructs the mobile data communication device to transmit one of the requesting signal and the finalizing signal for triggering an elevator according to an embodiment of the second aspect of the invention to one of executing and controlling the method according to an embodiment of the first aspect of the invention.

According to a fourth aspect of the invention, a computer readable means is proposed. The computer readable means has stored thereon a computer program product according to an embodiment of the third aspect of the invention.

Ideas underlying embodiments of the present invention may be interpreted as being based, inter alia, on the following observations and recognitions.

Briefly summarized, embodiments of the method proposed herein benefit from technical features included in modern elevators for implementing an alternative approach for operating the elevator during an inspection process. While conventional elevators generally had passive shaft doors, some modern elevators will have active shaft doors in which an active door drive is provided for opening and closing shaft door blades independent of other components of the elevator, particularly independent of the car and its car door. It is suggested to use such functionality for implementing an alternative approach of initiating an inspection procedure and operating the elevator during the inspection procedure.

First, some characteristics of components of the elevator proposed herein and its functionalities will be described in more detail.

Regarding its car, its elevator shaft, its drive engine and basic functionalities of its engine controller, the elevator proposed herein may be similar to conventional elevators. Therein, the engine controller may control the drive engine for displacing the car during normal operation for example in response to calls received from one of multiple landing operation panels provided at each of the floors in a building and/or from a car operation panel provided within the elevator car.

However, compared to most conventional elevators, the elevator proposed herein differs with regard to its shaft doors and a way these shaft doors may be opened and closed. Particularly, in the present elevator, each of the shaft doors at each of multiple floors shall have its own associated active door drive. Such door drive generally includes an actuator. Such actuator may be implemented using for example an electric motor, hydraulics, pneumatics or similar means. The actuator may cooperate with one or more shaft door blades such as to displace the one or more shaft door blades between an open state, in which the shaft door enables access from the floor to the elevator shaft, and a closed state, in which such access is blocked.

The active door drive and its actuator may be controlled by a door controller. Each shaft door may have its own door controller for controlling its door drive. Alternatively, a central door controller may control door drives of multiple shaft doors.

Generally, during normal operation of the elevator, the door controller(s) will control the operation of the active door drives of the shaft doors in reaction to signals received from the engine controller and/or other components of the elevator, these signals indicating that the car is currently stopped at one of the floors, such that the door controller may then control opening the shaft door at this one of the floors by actuating its associated door drive.

During normal operation, a shaft door shall exclusively be opened when the elevator car is parked adjacent to this shaft door. In such situation, the car door and the respective shaft door are directly opposite to each other.

However, in order to enable inspection of the elevator, exceptions from this general rule may have to be implemented. Particularly, a technician shall be able to open a shaft door while the car is not parked directly adjacent to this shaft door in order to have access to the elevator shaft.

For safety reasons, it must be guaranteed that no unauthorized person may open a shaft door while the car is not parked at this shaft door. Furthermore, measures should be taken to avoid any risks to a technician when the technician opens the shaft door while the car is not at this shaft door.

In order to satisfy such requirements, it is suggested to provide signal receptors at each of the multiple floors. Such signal receptors may be devices which may receive a signal transmitted from another device or entered by the technician. For example, the signal receptors may be sensors, switches, push buttons or similar devices.

Particularly, the signal receptors may be configured to receive a so-called requesting signal. The requesting signal shall indicate that the elevator shall be prepared for inspection. The requesting signal may be such that and/or may be transmitted such that only authorized technicians may provide such requesting signal to the signal receptors. For example, the requesting signal may include a secret code or encryption. Furthermore, the requesting signal may be generated by a device which is generally only accessible by authorized technicians. Additionally or alternatively, the requesting signal may be generated using a code or a computer program which is generally only accessible by authorized technicians.

Furthermore, in order to satisfy the above requirements, technical measures are implemented which allow the technician to open the shaft door only when the car had before been driven to a location where it may prevent the technician from falling into the elevator shaft.

Accordingly, in the method proposed herein, providing of the requesting signal may be initiated by a technician. As further described below, such requesting signal may be provided in various manners. The requesting signal may then be received by the signal receptor located at the floor at which the technician is currently situated.

Upon receiving the requesting signal, it is first to be decided whether the floor at which the signal receptor receiving the requesting signal is located is the lowermost floor serviced by the elevator or is one of the upper floors above this lowermost floor.

In case the requesting signal was received by the signal receptor at the lowermost floor, this means that the technician wants to enter the elevator shaft at the shaft door of this lowermost floor. In such case, it may be assumed that the technician wants to enter a pit of the elevator shaft. For enabling such entering of the pit, the car is first controlled to be driven to a position above the lowermost floor, i.e. for example to a position next to the first floor or one of the higher upper floors. Upon the elevator shaft being then emptied from the car, the door controller of the shaft door at the lowermost floor may then control the door drive of this shaft door to actively open. Accordingly, the technician may enter the elevator shaft through this shaft door to provide inspection services at the pit of the elevator shaft.

In case the requesting signal was received by one of the signal receptors not being located at the lowermost floor but at one of the upper floors, the engine controller is first instructed to control the drive engine to displace the car to a position such that the roof of the car is adjacent to the shaft door at the floor from which the requesting signal was received. In other words, the car is driven to a position where its car door is not directly opposite to the shaft door but where its roof is next to the shaft door. For example, the car may be displaced and stopped such that its roof is next to a lower end of the shaft door. Only after the car has been displaced and stopped in such a way, the door controller is instructed to control the door drive of the respective shaft door to actively open the shaft door. Accordingly, when the technician enters the elevator shaft through this shaft door, the technician may step onto the roof of the parked car. Particularly, the technician may be prevented from falling into the elevator shaft by the car being parked with its roof adjacent to the opened shaft door.

Furthermore, in reaction to receiving the requesting signal at one of the signal receptors, the engine controller of the elevator may be switched to an inspection mode. Such switching to an inspection mode may take place directly upon receiving the requesting signal, i.e. before displacing the car. Alternatively, switching to the inspection mode may be implemented to take place while or after the car is displaced to its destination location above the lowermost floor or with its roof adjacent to the shaft door at the floor where the requesting technician is waiting. This inspection mode differs from the previous normal operation mode at least in that calls entered by passengers at landing operation panels and/or a car operation panel are ignored. Accordingly, during inspection mode, the elevator may no more provide any transportation services to passengers. Thus, during inspection mode, there is no risk of the car being displaced in reaction to passenger's calls.

With the method proposed herein and the elevator configured to implement such method, inspection of the elevator may be rendered simpler and more secure for a technician. Particularly, by simply providing the requesting signal to one of the signal receptors of the elevator, the technician may initiate a procedure in which the car is automatically driven to a position such that the technician may securely enter the elevator shaft, either at the level of the pit of the elevator shaft or at the level of one of the upper floors. Furthermore, the shaft door at which the technician is waiting and provided the requesting signal to the local signal receptor may be automatically opened to provide access to the elevator shaft.

According to an embodiment, in the inspection mode, the engine controller prevents the drive engine from displacing the car after the car having arrived at one of the first and second position, respectively.

In other words, as a first action upon executing the method proposed herein, the car is driven to an intended destination location, i.e. the car is driven to the first position such that its roof is adjacent to the shaft door at the floor at which the requesting signal was provided or the car is driven to the second position above the lowermost floor in case the requesting signal was provided at the lowermost floor. Having arrived at such destination location, the engine controller is switched to a mode in which no further displacing of the car is enabled. Accordingly, during the subsequent inspection, the location of the car is fixed. Thus, at least as soon as the respective shaft door is opened and the technician may enter the elevator shaft for accessing the pit or stepping onto the car roof, the car is not allowed to be displaced anymore. Accordingly, in such inspection situation, there is no risk for the technician to be hurt by a displacing car. Thus, in such inspection mode, safety for the technician is increased.

Furthermore, as displacing the car is generally not allowed as long as one of the shaft doors is open and a technician has access to the elevator shaft, there is no more any need for specific controlling means to be provided to the technician for controlling displacements of the car during an inspection procedure.

Explained differently, while in conventional approaches, a specific controlling means was provided at the roof of the car and/or at the pit of the elevator shaft to allow the technician to displace the car during inspection, the approach described herein may intentionally dispense with the option of enabling the technician to displace the elevator while the technician being within the elevator shaft. Thereby, not only the safety of the technician may be increased but also hardware such as the specific controlling means, which otherwise would have to be provided to the technician for controlling any displacement during inspection from the pit or the car roof, is not necessary and costs for such hardware may be avoided.

According to an embodiment, if, during the proposed method, the one of the floors is not the lowermost floor, the engine controller controls the drive engine to displace the car to a position such that the roof of the car is flush with a bottom at the one of the floors.

In other words, the first position may be set such that a level of an upper side of the car roof may substantially correspond to a level of the bottom at the floor at which the requesting signal was provided to the local signal receptor. Accordingly, for example no dangerous step is generated between the bottom of the floor and the car roof and the technician may easily and securely step onto the car roof as soon as the shaft door has opened.

In this context, the term "flush" may be interpreted for example as the level of the bottom at the floor and the level of the upper side of the car roof corresponding to each other within an acceptable tolerance. Such tolerance may be for example smaller than 50 cm, preferably smaller than 20 cm or smaller than 5 cm or even smaller than 2 cm.

According to an embodiment, for enabling the receiving of the requesting signal during the proposed method, a technician initiating the transmitting of the receiving signal has to be at the one of the floors in proximity to one of the signal receptors being arranged at the floor and outside of the elevator shaft.

In other words, the signal receptors are configured such that the way in which the requesting signal is provided to the signal receptors is implemented such that it is guaranteed that the technician initiating the transmission of the receiving signal may not be situated somewhere far away from the elevator or, particularly, may not be situated within the elevator shaft. Instead, it has to be guaranteed that the technician is situated close to the signal receptor located at the floor from which the technician wants to enter the elevator shaft, wherein the signal receptor has to be arranged outside the elevator shaft. Particularly, the technician should only be able to provide the requesting signal to the signal receptor as long as the technician is sufficiently close to this signal receptor.

"Proximity" may mean in that case that a distance between the technician and the signal receptor should be smaller than a shortest distance between the signal receptor and the shaft door at the respective floor. For example, "proximity" may mean that the distance between the technician and the signal receptor should be less than 10 m, preferably less than 3 m or even less than 1 m.

Accordingly, it may be guaranteed that the technician may only provide the requesting signal as long as he is located within the respective floor and he is not in the elevator shaft. Thus, it may be prevented that the technician may start the proposed method by providing the requesting signal while not himself being present at the respective floor. Thereby, it may be prevented that, during the method, the floor door at the respective floor opens without the technician being nearby. Furthermore, it may be prevented that the technician may start the proposed method by providing the requesting signal while for example being within the elevator shaft, i.e. while being for example in the elevator car. Accordingly, the entire inspection procedure may be rendered more secure, both for the technician as well as for other persons.

According to an embodiment, the signal receptor may receive the requesting signal via short range wireless data communication from a data communication device.

This means that the technician may use a data communication device for generating the requesting signal and providing the requesting signal to the signal receptor. Therein, the signal receptor and the data communication device should exchange the requesting signal using a short range wireless data communication technique. Such short range wireless data communication technique may be for example Bluetooth communication or any other kind of near field communication (NFC). The short range wireless data communication technique may have characteristics such that transmission of the requesting signal is only enabled as long as the data communication device is in proximity to the signal receptor. "Proximity" may be interpreted as defined above.

For example, the requesting signal may be transmitted by a mobile data communication device carried by a technician.

Such mobile data communication device may be a portable device having a processor for data processing, some memory for data storage and a data communication interface for exchanging data with other devices. For example, such mobile data communication device may be a smart mobile phone of the technician, a tablet, a laptop, etc. Such mobile data communication device may be programmed using for example a specific application ("app") for generating and transmitting the requesting signal e.g. upon being actuated by the technician.

As an alternative, the requesting signal may be transmitted using a passive mobile data communication device in which data may be stored but may not be processed and/or may not be actively emitted. For example, such passive mobile data communication device may be an RFID (radio frequency identifier) device which, upon request, may emit a radiofrequency code. Therein, the radiofrequency code may represent or encrypt the requesting signal and may be received by the signal receptor.

According to an alternative embodiment, the signal receptor may receive the requesting signal via manually actuating the signal receptor by a technician.

In such embodiment, the technician may not need any portable technical device for generating and providing the requesting signal. Instead, the technician may provide the requesting device by directly manually cooperating with the signal receptor. For example, the signal receptor may have one or more pushbuttons, switches or similar sensors to be actuated.

Preferably, the signal receptor is configured such that and/or the requesting signal is to be generated by manually actuating the signal receptor such that only an authorized technician may provide the receiving signal. For example, the signal receptor may be protected by a protection means preventing actuation of the signal receptor and the protection means may only be removed by the technician, for example by using a key or similar means. Alternatively, the signal receptor may be actuated by everyone but the specific manner in which it has to be actuated for generating the requesting signal is known only by authorized technicians. For example, the signal receptor may have to be actuated with a patterned sequence of manual actuations, the patterned sequence of manual actuation thereby forming a kind of code representing the requesting signal. Specifically, the signal receptor could be the, or part of the, landing operation panel provided at each of the floors near to the local shaft door and the receiving signal can be entered by actuating a push button, switch or sensor of such landing operation panel in a predefined patterned actuation sequence.

According to an embodiment, the method proposed herein further comprises the following steps:

receiving a finalizing signal at the one signal receptor, in reaction to receiving the finalizing signal:

instructing the door controller to control the door drive of the shaft door at the one of the floors to actively close, and switching the engine controller back to a normal operation mode.

In other words, the method proposed herein may not only include receiving a requesting signal for entering into a procedure during which the car is driven to a specific first or second position and the engine controller is switched into inspection mode (corresponding to a "check-in"), but may additionally include receiving a finalizing signal. Receiving such finalizing signal may indicate that an inspection procedure has been completed (corresponding to a "check-out"). In reaction to receiving the finalizing signal, the shaft door which had previously been opened in reaction to receiving the requesting signal may be closed again and the engine controller may be switched back to normal operation.

Accordingly, by generating and transmitting the finalizing signal, a technician may indicate that he has finished the inspection procedure. Therein, similar as explained above with respect to receiving the requesting signal, the way the signal receptors are located and/or the way the finalizing signal is to be transmitted to the signal receptors may be adapted such that it is guaranteed that the finalizing signal may only be transmitted when the technician has left the elevator shaft and has come back close to the signal receptor at the floor and through the shaft door through which he previously entered the elevator shaft.

According to an embodiment, upon receiving the requesting signal, an identity of a technician initiating a transmission of the requesting signal may be detected.

This means when one of the signal receptors receives a requesting signal, not only reception of the requesting signal is registered for triggering subsequent reactions such as the displacing of the car and the switching to the inspection mode, but it is also detected which person has transmitted the requesting signal.

Therein, the identity of the technician initiating the transmission of the requesting signal may be detected using various technical means. For example, a data communication device used for transmitting the requesting signal may include identification data into a data package representing the requesting signal. Such identification data may e.g. identify the owner or the user of the data communication device. Alternatively, the technician initiating the transmission of the requesting signal may be identified using image analysis of a picture taken with a camera, analysis of a fingerprint taken by a fingerprint sensor, or various other means.

Upon having detected the identity of the technician, it may for example be checked whether this technician is authorized to starting the method proposed herein and to then entering the elevator shaft. Additionally or alternatively, the identity of the technician may be stored such that, for example at a later point in time, it may be tracked who has inspected the elevator.

Furthermore, according to a specific embodiment, upon receiving the finalizing signal, an identity of a technician initiating a transmission of the finalizing signal is detected and the engine controller is switched back to a normal operation mode only in case the identity of the technician initiating the transmission of the requesting signal is identical to the identity of the technician initiating the transmission of the finalizing signal.

In other words, the identity of a technician may be detected both, at the beginning of the method proposed herein, i.e. upon receiving the requesting signal and therefore before starting the inspection, as well as upon completion of the method proposed herein, i.e. upon receiving the finalizing signal and therefore when completing the inspection. In that case, the engine controller is switched back to normal operation only, if the same technician has originally transmitted the requesting signal and later transmits the finalizing signal.

Thereby, it may for example be guaranteed that no other person except for the technician originally initiating the inspection may switch back the engine controller to normal operation. Particularly, in a situation where a first technician initiated the inspection by sending a requesting signal and entering the elevator shaft, it may be prevented that for example a second technician, who did not initiate the inspection and who did not realize that the first technician is within the elevator shaft, may switch back the elevator to normal inspection, thereby endangering the first technician.

In an elevator configured for executing or controlling embodiments of the method proposed herein, at least each of the plurality of the door controller may be configured to fulfil SIL3 requirements. In a preferred elevator configured for executing or controlling embodiments of the method proposed herein, each of the plurality of signal receptors, the engine controller, the door controller and a communication established for exchanging signals between the plurality of signal receptors, the engine controller and the door controller may be configured to fulfil SIL3 requirements.

That means that, in the elevator, all components participating in monitoring and/or controlling any car motions and opening actions of shaft doors may have to fulfil high safety requirements as defined in the SIL3 (safety integrity level 3) standard. Accordingly, it may be guaranteed that no malfunctions in one of the components may result in creating potentially dangerous situations such as displacing the car while a technician is within the elevator shaft or opening a shaft door while no car has been driven to the first position close to the shaft door.

The engine controller and/or the door controller(s) comprised in the elevator proposed herein may be programmable. They may have for example a processor for executing computer readable instructions and/or processing data and a memory for storing the instructions and/or data. The computer program product comprising the computer readable instructions may be in any computer readable language. Upon executing the computer readable instructions, the engine controller and/or the door controller(s) perform or control steps of the method proposed herein. Optionally, the engine controller and the door controller(s) may be implemented in one single controller device.

Furthermore, a computer program product in a form of an application ("app") may be used to instruct a mobile data communication device such as a smart phone to transmit one of the requesting signal and the finalizing signal for triggering an elevator such that the elevator executes or controls the method proposed herein.

Finally, a computer readable medium comprising the computer program product described above stored thereon may be any portable computer readable medium such as a CD, a CVD, a flash memory, etc. for transient or non-transient data storage. Alternatively, the computer readable medium may be a computer or part of a computer network such as a cloud or the internet, such that the computer program product may be downloaded therefrom.

It shall be noted that possible features and advantages of embodiments of the invention are described herein partly with respect to a method for operating an elevator for an inspection and partly with respect to an elevator configured for implementing such method. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawing. However, neither the drawing nor the description shall be interpreted as limiting the invention.

DESCRIPTION OF THE DRAWINGS

FIG. 1 shows an elevator configured for executing a method for operating the elevator for an inspection according to an embodiment of the invention.

The FIGURE is only schematic and not to scale. Same reference signs refer to same or similar features.

DETAILED DESCRIPTION

FIG. 1 shows an elevator 1. The elevator 1 is shown in a side view. Furthermore, a portion of the elevator 1 is shown in a front view, as visualized in a partial view inside a dashed frame line.

The elevator 1 comprises a car 3 which is displaceable along an elevator shaft 5. The elevator car 3 is held and displaced by a suspension traction means 7 such as a rope or a belt. At its opposite end, the suspension traction means 7 is coupled to a counterweight 9. The suspension traction means 7 is driven by a drive engine 11. The drive engine 11 is controlled by an engine controller 13. It is to be noted that the arrangement of the suspension traction means 7 and the drive engine 11 shown in FIG. 1 is represented in a very schematic manner.

The elevator car 3 comprises a car door 15 for opening and closing an access to the elevator car 3. The car door 15 may be opened and closed actively by a car door drive 17. The car door drive 17 is controlled by a car door controller 19.

At each of multiple floors 21, at least one shaft door 23 is provided. The shaft door 23 may be opened and closed for granting or blocking access to the elevator shaft 5. The elevator 1 presented herein comprises an active door drive 25 at each of the shaft doors 23 for actively opening and closing the respective shaft door 23 by laterally displacing shaft door blades 27. Each of the door drives 25 is controlled by a door controller 29. In the example presented herein, the door controller 29 is integrated into the engine controller 13. It is to be noted that, for reasons of a simpler formulation, the terms "door drive 25" and "door controller 29" shall refer herein only to the shaft doors 23, not to the car door 15 (which has a "car door drive 17" and a "car door controller 19").

Furthermore, at each of the multiple floors 21, a landing operation panel 31 is provided in a neighborhood to the shaft door 23. For example, such landing operation panel 31 may comprise one or more push buttons 32 which may be actuated by passengers for calling the car 3 to come to their floor 21.

Additionally, in the example shown, a separate signal receptor 33 is arranged next to the landing operation panel 31. The signal receptor 33 is configured for receiving signals, such as a requesting signal and a finalizing signal.

During normal operation of the elevator 1, the engine controller 13 controls the drive engine 11 for displacing the car 3 to one of the floors 21 in response to passenger's calls provided by actuating one of the landing operation panels 31. Therein, the drive engine 11 is controlled such that the car 3 is stopped at a landing position such that its car bottom 35 is substantially flush with a bottom 37 at the floor 21 at which the car 3 shall collect or deliver passengers.

For inspection purposes, the normal operation of the elevator 1 has to be temporarily interrupted. For such purpose, according to the method proposed herein, a technician may approach the elevator 1 at one of the floors 21 such as for example a lowermost floor 21' or one of multiple floors 21", 21'''. Upon being close to the shaft door 23 at this floor 21, the technician 39 may initiate emitting a requesting signal. Such requesting signal is then received by the signal receptor 33 at the respective floor 21. Such receiving of the requesting signal may be communicated from the signal receptor 33 towards for example the engine controller 13 and/or the door controller 29. In reaction to receiving such requesting signal, it is then checked whether the requesting signal was received from the signal receptor 33 arranged at the lowermost floor 21' or from one of the signal receptors 33 arranged at one of the upper floors 21", 21'''.

When the requesting signal was received at one of the signal receptors 33 at one of the upper floors 21", 21''', the engine controller 13 will control the drive engine 11 to displace the car 3 to a position such that a roof 41 of the car 3 is adjacent to the shaft door 23 at the floor 21''' from which the requesting signal had been received. Preferably, the car 3 is stopped at a level at which an upper surface of its roof 41 is substantially flush with the bottom 37 at the respective floor 21'''. Subsequently, the door controller 29 controls the door drive 25 at the respective floor 21''' to actively open the associated shaft door 23. Accordingly, the technician 39 may enter the elevator shaft 5 by stepping on top of the roof 41 of the waiting car 3. At such location, the technician 39 may inspect, modify, repair or replace various components of the elevator 1 such as for example car guide shoes, a car brake, a front bracket fixation, the suspension traction means 7 and end connectors at a counterweight side as well as at a car side, counterweight guide shoes, shaft information, a load measuring device, a deflection pulley in a head room and/or other components (components not shown for simplification and clearness of the FIGURE).

The car 3 adjacent to the shaft door 23 may not necessarily be in a position that the roof 41 is flush with the bottom 37 at the respective floor 21'''. It may be advisable to displace the car 3 to a position such that the roof 41 is significantly above the bottom 37 at the floor 21'''. For example, such a car position can be useful when the technician 39 must inspect, repair or replace the drive engine 11, which is, as shown exemplary in FIG. 1, arranged in the region of the shaft head of the elevator shaft. In this case, the technician 39 may climb up to the car roof 41 which would be about 50 cm or more above the bottom at the uppermost floor.

When the requesting signal was received at the signal receptor 33 at the lowermost floor 21', the engine controller 13 will control the drive engine 11 to displace the car 3 to a position above the lowermost floor 21', i.e. such that the car bottom 35 is sufficiently above a pit 43 of the elevator shaft 5, for allowing the technician 39 to enter such pit 43. Subsequently, the door controller 29 controls the door drive 25 at the lowermost floor 21' to actively open the associated shaft door 23. Accordingly, the technician 39 may enter the pit 43 of the elevator shaft 5. In the pit 43, the technician may inspect, modify, repair or replace various components of the elevator 1 such as for example a traction sheave pulley on a machine, a slack belt (tension on traction means), an electrical drive and motor of a ventilator and/or other components (components not shown for simplification and clearness of the FIGURE). Furthermore, the technician 39 may clean the pit 43.

Furthermore, upon having received the requesting signal, the engine controller 13 is switched to an inspection mode. In such inspection mode, calls entered by passengers for example at one of the landing operation panels 31 or at a car operation panel are ignored. Furthermore, any displacement of the car 3 is prevented as long as the shaft door 23 is opened at one of the floors 21 in reaction to receiving the requesting signal.

In an exemplary embodiment, the technician 39 may use a data communication device 45 such as his smart phone for generating and transmitting data forming the requesting signal. For such purpose, a specific application may be programmed and uploaded to the data communication device 45. Upon activation of this application, the data communication device 45 may send the data forming the requesting signal e.g. as electromagnetic waves. The electromagnetic waves may be received by a suitable sensor comprised in the signal receptor 33. Preferably, the data communication is established as a short-range wireless data communication such that the signal receptor 33 may receive the requesting signal only in case the data communication device 45 is in a sufficiently close proximity to the signal receptor 33.

In an alternative embodiment, the signal receptor 33 may not be implemented as a separate device but may be part of an existing device which normally serves for other purposes. For example, the signal receptor 33 may be integrated into the landing operation panel 31 at each of the floors 21. In such embodiment, the technician 39 may provide the requesting signal for example by actuating the landing operation panel 31 in a specific manner. For example, the push buttons 32 of the landing operation panel 31 may be actuated in accordance to a specific actuation sequence, such actuation sequence being only known to authorized technicians.

Upon having completed the inspection works, the technician 39 may leave the elevator shaft 5 through the opened shaft door 23. The technician 39 may then transmit a finalizing signal which may be received by the signal receptor 33. Upon receiving the finalizing signal, the door controller 29 may be instructed to control the door drive 25 of the opened shaft door 23 to close this shaft door 23. Subsequently, the engine controller 13 may be switched back into its normal operation mode.

With the method and the elevator 1 proposed herein, inspection of the elevator 1 may be substantially simplified and may be made more secure. Particularly, upon initiation by transmitting the requesting signal, a shaft door 21 next to the technician 39 may be opened actively and automatically. Furthermore, the car 3 has already previously been driven to a suitable location with its roof 41 being substantially flush to the floor bottom 37, such that the technician 39 may easily and securely step onto the car roof 41. Alternatively, the technician 39 may easily enter the pit 43 after the car 3 has been automatically removed from such pit 43. As, during inspection mode, no further displacement of the car 3 is allowed, risks of injury for the technician 39 are minimized. Furthermore, there is no need for any control unit on the car roof 41 or in the pit 43. Generally, there is also no need for any toe guard on the car roof 41 and/or for an apron on a car sill. Accordingly, costs for such hardware may be saved.

Finally, it should be noted that the term "comprising" does not exclude other elements or steps and the "a" or "an" does not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating an elevator for an inspection, the elevator including a car being displaceable along an elevator shaft, a drive engine displacing the car, a plurality of shaft doors, at least one of the shaft doors being arranged at each of multiple floors including a lowermost floor and at least one upper floor, each of the shaft doors having an associated active door drive for reciprocally opening and closing the shaft door, a plurality of signal receptors, at least one of the signal receptors being arranged at each of the floors, an engine controller controlling operation of the drive engine, and a door controller for controlling operation of the active door drives, the method comprising the steps of:

receiving a requesting signal at one of the signal receptors at one of the floors;

responding to the requesting signal by, when the one floor is not the lowermost floor, instructing the engine controller to control the drive engine to displace the car to a first position such that a roof of the car is adjacent to the shaft door at the one floor, and when the one floor is the lowermost floor, instructing the engine controller to control the drive engine to displace the car to a second position above the lowermost floor;

instructing the door controller to control the associated door drive of the shaft door at the one floor to open the shaft door; and switching the engine controller to an inspection mode.

2. The method according to claim 1 wherein, when in the inspection mode, the engine controller prevents the drive engine from displacing the car after the car has arrived at either of the first position and the second position.

3. The method according to claim 1 wherein, when the one floor is not the lowermost floor, the engine controller controls the drive engine to displace the car to the first position such that the roof of the car is flush with a bottom at the one floor.

4. The method according to claim 1 wherein the receiving of the requesting signal is enabled by a technician initiating transmitting of the receiving signal when at the one floor in proximity to the one signal receptor arranged at the one floor and the technician being outside of the elevator shaft.

5. The method according to claim 1 wherein the one signal receptor receives the requesting signal via short range wireless data communication from a data communication device.

6. The method according to claim 5 wherein the requesting signal is transmitted by the data communication device being a mobile data communication device used by a technician.

7. The method according to claim 1 wherein the one signal receptor receives the requesting signal via a technician manually actuating the one signal receptor.

8. The method according to claim 1 further comprising:

receiving a finalizing signal at the one signal receptor; and responding to the finalizing signal by, instructing the door controller to control the associated door drive of the shaft door at the one floor to close the shaft door, and switching the engine controller to a normal operation mode.

9. The method according to claim 8 wherein, upon receiving the requesting signal, detecting an identity of a technician initiating a transmission of the requesting signal and wherein, upon receiving the finalizing signal, detecting an identity of a technician initiating a transmission of the finalizing signal and switching the engine controller to a normal operation mode only when the identity of the technician initiating the transmission of the requesting signal is identical to the identity of the technician initiating the transmission of the finalizing signal.

10. The method according to claim 1 wherein, upon receiving the requesting signal, detecting an identity of a technician initiating a transmission of the requesting signal.

11. An elevator adapted to execute and control the method for operating according to claim 1, the elevator comprising:

a car being displaceable along an elevator shaft;

a drive engine for displacing the car;

a plurality of shaft doors along the elevator shaft, at least one of the shaft doors being arranged at each of multiple floors including a lowermost floor and at least one upper floor, each of the shaft doors having an associated active door drive for reciprocally opening and closing the shaft door;

a plurality of signal receptors, at least one of the signal receptors being arranged at each of the floors;

an engine controller for controlling operation of the drive engine; and a door controller for controlling operation of the active door drives.

12. The elevator according to claim 11 wherein each of the signal receptors is arranged outside of the elevator shaft.

13. The elevator according to claim 11 wherein each of the signal receptors, the engine controller, the door controller and a communication established for exchanging signals between the signal receptors, the engine controller and the door controller is configured to fulfil SIL3 requirements.

14. A computer program product comprising one of:

computer readable instructions that, when performed by a processor in the elevator according to claim 11, instruct the elevator to execute and control the method for operating; and computer readable instructions that, when performed by a processor in a mobile data communication device, instruct the mobile data communication device to transmit at least one of the requesting signal and a finalizing signal for triggering the elevator according to claim 11 to execute and control the method for operating.

15. A non-transitory computer readable medium comprising the computer program product according to claim 14 stored thereon.

* * * * *